United States Patent [19]

Gutowski et al.

[11] 3,948,136

[45] *Apr. 6, 1976

[54] MITRE BOX WITH IMPROVED INDEXING MEANS

[75] Inventors: Antoni P. Gutowski, New Britain; Donald P. Ryan, New Hartford, both of Conn.

[73] Assignee: The Stanley Works, New Britain, Conn.

[ * ] Notice: The portion of the term of this patent subsequent to Mar. 25, 1992, has been disclaimed.

[22] Filed: Mar. 19, 1975

[21] Appl. No.: 559,776

Related U.S. Application Data

[63] Continuation-in-part of Ser. No. 421,430, Dec. 3, 1973, Pat. No. 3,872,761.

[52] U.S. Cl. ..... 83/767; 83/581

[51] Int. Cl.[2] ..... B27G 5/02

[58] Field of Search ..... 83/767, 581

[56] References Cited

UNITED STATES PATENTS

| | | | |
|---|---|---|---|
| 770,834 | 9/1904 | Traut | 83/767 |
| 834,073 | 10/1906 | Parsons | 83/767 X |
| 1,214,862 | 2/1917 | Wilson | 83/767 |
| 1,952,518 | 3/1934 | Stowell | 83/767 X |

*Primary Examiner*—J. M. Meister

[57] ABSTRACT

A mitre box embodying improved indexing means is provided for use in cutting the ends of two pieces of material at an angle to enable the two ends to be fitted together to form a joint. The mitre box includes a base which is supported on a pair of arch-like legs. The latter legs are positioned in suitably spaced relation relative to each other and are operable to provide a support means for supporting the mitre box on a suitable support surface. Mounted on the base is an indexing plate which is used for purposes of identifying the angle at which the ends of the strips, i.e., pieces will be cut. A swivel assembly is mounted on the mitre box for pivotal movement relative to the indexing plate. The swivel assembly cooperates with the indexing plate to determine the angle at which cuts will be made. A pair of upright assemblies are supported at the opposite ends of the swivel assembly whereby they extend substantially perpendicularly to the plane of the swivel assembly. The pair of upright assemblies function as a guiding and aligning means for the saw during the cutting operation. A wedge may be also employed with the mitre box for use in obtaining a 30° angle.

10 Claims, 6 Drawing Figures

MITRE BOX WITH IMPROVED INDEXING MEANS

CROSS-REFERENCE TO RELATED APPLICATION

This application is a continuation-in-part of copending application Ser. NO. 421,430 filed Dec. 3, 1973, now U.S. Pat. No. 3,872,761 granted March 25, 1975.

BACKGROUND OF THE INVENTION

Those who are involved in the construction and/or repair of articles made particularly from wood have long been familiar with the existence of mitre boxes. Basically, mitre boxes comprise a means which is operable for purposes of cutting the ends of a pair of strips of material at equal angles so as to enable the cut ends to be jointed in a mitre joint. More specifically, a mitre box comprises normally a portable device which includes generally speaking a base, guide means for the instrument by which the cutting is accomplished, and means for establishing the angle at which the ends of the pieces of material are cut.

As is readily apparent from a reference to the prior art, there have been provided heretofore a variety of devices which have been designed to be operable in the manner of a mitre box. One method of classifying the various forms of such devices is by complexity of their structure and/or by their relative cost to manufacture. For example, probably one of the simplese forms of devices which has been employed prevously for cutting the ends of two pieces of material at equal angles is the type which consists solely of support means for the pieces of material and guide means for the cutting instrument. However, such a device is commonly characterized by the fact that there is only one angle at which the ends of the pieces of material can be cut. More specifically, this form of device embodies no means whereby the angle of cut can be varied. For some application, such a device may be perfectly adequate. Namely, its simplicity insofar as concerns the method of use thereof as well as the degree of accuracy obtainable therewith makes such a device suitable for use by the average amateur do-it-yourself homeowner. Moreover, such a device is generally advantageously characterized by the fact that the cost of purchase thereof is relatively minimal.

The degree of accuracy obtainable with the aforedescribed form of mitre box as well as the lack of flexibility thereof are commonly found to render such a mitre box unsuitable for use by a workman such as a carpenter or other similarly skilled individual who earns his livelihood working with wood. To meet the needs of this type of individual, it has been necessary to provide a more complex form of mitre box. Namely, it has been necessary to provide a mitre box which embodies means operable for purposes of enabling the angle at which the ends of pieces of material are cut to be varied. Such devices have been known heretofore as evidenced by reference to the prior art. One area however, in which prior art forms of this type of mitre box have often suffered is in the relative precision with which the angle of cut is established. More specifically, it has often been found that a rather difficult and/or time consuming procedure must be followed in order to ensure that the components of the mitre box are properly oriented relative to each other so that the angle at which the ends of the pieces of material are cut is acutally the angle at which it is desired taht they be cut. In addition, insofar as concerns the cost thereof, this form of mitre box is commonly found to be relatively more expensive than the form described in the preceding paragraph by virtue of the embodiment therein of means operable for varying the angle of cut.

Apart from the above described mitre boxes which have been available in the prior art heretofore, there also exists a number of other different forms of mitre boxes which are characterized in that they embody relatively complex forms of structure. Mitre boxes of the latter type have commonly been found employed in woodworking companies and/or other types of facilities wherein the construction and/or repair of articles made from wood takes place. One advantage possessed by the latter type of mitre box resides in the fact that through the use thereof one is capable of establishing the angle of cut with a high degree of precision. On the other hand, disadvantages of this type of mitre box are that by virtue of its complex structure and relatively high cost, the use thereof is generally restricted to woodworking companies, etc. which are capable of providing a high rate of utilization thereof as well as are capable of justifying the expense represented thereby.

Thus, although a variety of different types of mitre boxes have been developed previously, there nevertheless has existed a need to provide a mitre box which embodies means operable to provide a simple and more effective method of establishing with high precision the angle of cut than that obtainable through the use of the aforedescribed first two types of mitre boxes, and which is less complex in structure and significantly less costly than the mitre box commonly utilized by woodworking companies.

Accordingly, it is an object of the present invention to provide a novel and improved mitre box operable for cutting the ends of pieces of material at equal angles.

It is also an object of the present invention to provide such a mtire box which embodies improved indexing means.

A further object of the present invention is to provide such a mitre box embodying improved indexing means capable to providing accurate indexing with a high degree of precision.

A still further object of the present invention is to provide such a mitre box with improved indexing means whereby the latter means is readily adjustable in a simple and efficient manner.

Yet another object of the present invention is to provide such a mitre box with improved indexing means which has a relatively simple structure and which is relatively inexpensive to manufacture.

Yet still another object of the present invention is to provide such a mitre box with improved indexing means which is capable of being provided with a wedge which is operable to provide a 30° angle.

SUMMARY OF THE INVENTION

It has now been found that the foregoing and related objects can be readily attained in a mitre box which functions as a means of cutting the ends of two pieces of material at an angle to enable the two ends to be fitted together to form a joint. The mitre box includes a base which is supported on a plurality of legs. The latter legs are positioned in suitably spaced relation relative to each other and are operable to provide a support means for supporting the mitre box on a suitable support suface. Mounted on the base is an indexing plate and a swivel assembly. The swivel assembly is mounted for pivotal movement relative to the indexing plate. The swivel assembly cooperates with the indexing plate to establish the angle at which the cuts will be made. A pair of upright assemblies are supported at the opposite ends of the swivel assembly whereby they extend substantially perpendicularly to the plane of the swivel assembly. The pair of upright assemblies function as a guiding and aligning means for the cutting instrument during the cutting operation.

In accordance with the preferred embodiment of the invention, the base of the mitre box is supported on a pair of arch-like legs. The indexing plate embodied in the mitre box is of relatively high precision construction capable of defining the angle of cut with a high degree of accuracy. In addition, the mitre box of the present invention is characterized by the fact that the angle of cut is capable of being adjusted in a simple and efficient manner. The swivel assembly which cooperates with the indexing plate includes a swivel having a detent pin mounted therein, a detent arm one end of which is secured on the detent pin for movement relative thereto, a shoulder screw which is cooperatively associated with both the aforementioned swivel and the detent arm, and a spring which is interposed between the other end of the detent arm and the swivel. Each of the pair of upright assemblies inculdes a pair of posts which are mounted at one end in a post support which is operable to support the posts in spaced relation relative to each other, the other ends of the posts being received in an upright tie, and intermediate the ends of the posts there being provided thereon a saw guide. Also, in accord with the preferred form of the invention, a wedge may be utilized with the mitre box for providing a 30° angle.

DETAILED DESCRIPTION OF THE ILLUSTRATED EMBODIMENT

Figure 1:
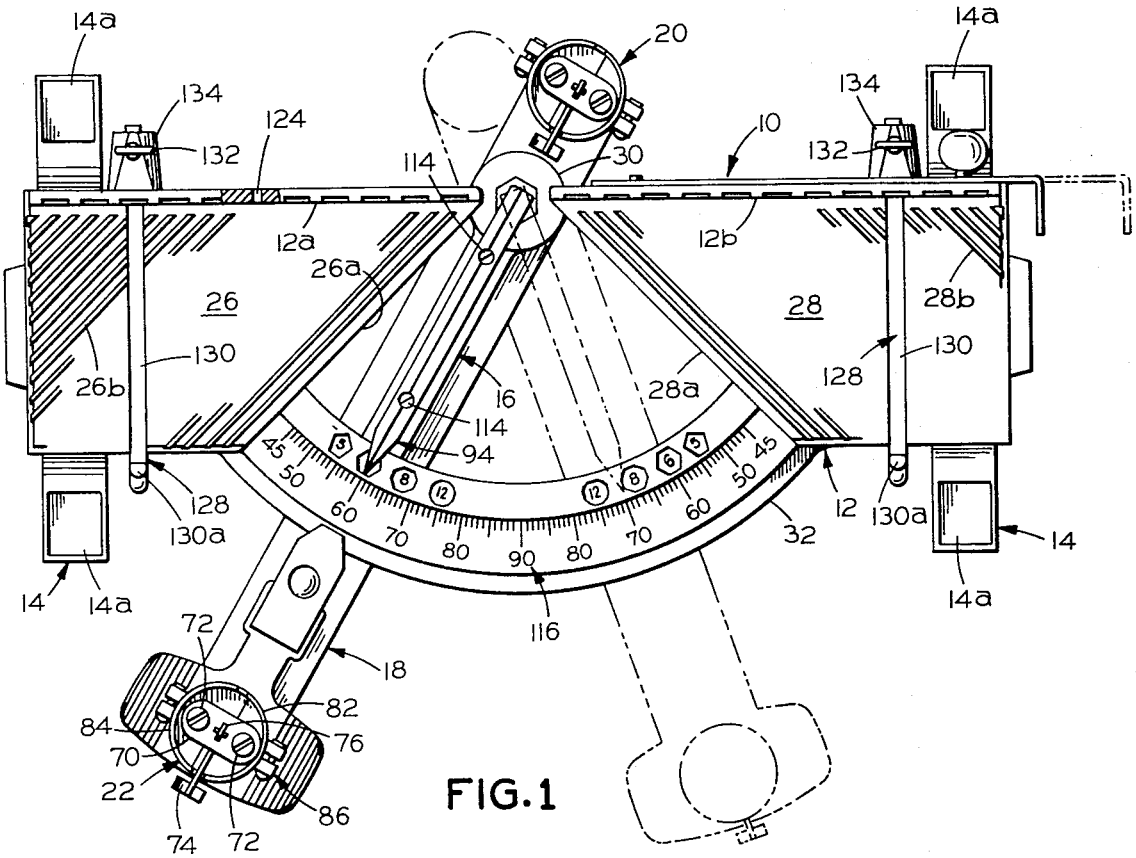
FIG. 1 is a top plan view of a mitre box constructed in accordance with the present invention, illustrating in solid lines the swivel assembly thereof in a first position and in broken lines the swivel assembly occupying a second position.

Referring now to the drawings, and more particularly FIG. 1 thereof, there is illustrated therein a mitre box, generally designated by reference numeral 10, embodying improved indexing means in accordance with the present invention. The mitre box 10 includes a base

Figure 5:
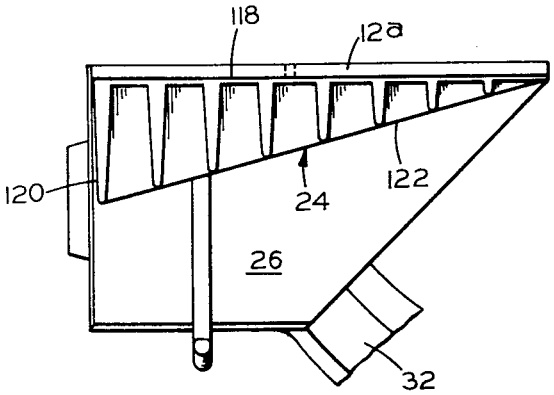
FIG. 5 is a top plan view of a portion of the base of a mitre box constructed in accordance with the present invention, illustrated with a wedge positioned on the base operable for providing a 30° angle.

12 which is supported on a pair of arch-like legs 14 in a manner which will be described, indexing means 16, a swivel assembly 18, and a pair of upright assemblies 20 and 22. In addition, as depicted in FIG. 5 of the drawings, the mitre box 10 in accord with the preferred form thereof is adapted to have a wedge 24 associated therewith for a purpose which willl be described subsequently.

As best understood with reference to FIG. 1 of the drawings, the base 12 includes a pair of substantially rectangular shaped portions 26 and 28. Each of the portions 26 and 28 has the inner end thereof, i.e., end **26*a* and 28*a*, respectively, formed so as to extend diagonally inwardly from the front to the rear of the base 12. Moreover, the ends 26*a* and 28*a* are interconnected together at the rear of the base 12 by means of a substantially circular shaped portion 30. At the front thereof, the ends 26*a* and 28*a* are interconnected by means of an arcuate shaped support member 32. In accord with the illustrated embodiment of the invention, all of the aforementioned components which comprise the base 12 are formed as an integral part thereof. However, if so desired, the base 12 could be formed of a plurality of separate components each being suitably fastened together to form an integral unit, without departing from the essence of the present invention. With further reference to FIG. 1 of the drawings, the top surfaces of the portions 26 and 28 are preferably provided with a plurality of diagonally extending ribs 26*b* and 28*b*. The latter ribs 26*b* and 28*b* operate to provide the portions 26 and 28** with the appearance of having a corrugated-like top surface.

Turning again to FIG. 1 of the drawings, as depicted therein the base 12 is supported on a pair of legs 14 which are suitably spaced relative to each other whereby to be positioned adjacent the opposite ends of the base 12. Each of the legs 14 resemble an arch-like confiuration. The legs 14 may be fastened to the under surface of the portions 26 and 28 of the base 12 through the use of any suitable conventional fastening means (not shown). In accoord with the preferred embodiment of the invention, the fastening of the legs 14 to the base 12 is accomplished through the use of a plurality of threaded fasteners (not shown) which are passed through suitable openings (not shown) provided for this purpose in the upper part of the arch-shaped legs 14 and received in threaded engagement in suitably positioned threaded openings (not shown) formed in the under surface of the portions 26 and 28 of the base 12. As shown in FIG. 1, each of the legs 14 is preferably provided with a cutaway portion **14*a* at each of the opposite ends thereof. Although not depicted in the drawings, an opening may be formed centrally within each of the cutaway portions 14*a* operable for purposes of permitting a fastener (not shown) to be passed therethrough whereby to enable the mitre box 10 to be detachably mounted through the use of threaded fasteners of a suitable supporting surface. The cutway portions 14*a* provide a means of obtaining access to the aforereferenced threaded fastener in the event that it is desired to mount the mitre box 10** in the aforedescribed manner.

With reference now to FIGS. 1–4 of the drawings, the swivel assembly 18 which is depicted therein is mounted to the base 12 for pivotal movement relative thereto. The swivel assembly 18 includes a swivel 34, a detent pin 36, a detent arm 38, a shoulder screw 40 and a spring 42. As best understood with reference to FIGS.

2 and 3 of the drawings, the swivel assembly 18 and more specifically the swivel 34 thereof is secured to the base 12 by means of a threaded fastener 44 which is received in a suitable opening (not shown) provided for this purpose in the circular-shaped portion 30 of the base 12. To this end, the threaded end of the fastener 44 is passed thorugh s suitable opening (not shown) provided therefor in one end of the swivel 34, with the latter being retained in a position on the end of the fastener 44 by means of a nut 46 which is tightened in place on the threaded end of fastener 44. In accord with the illustrated embodiment of the invention, a washer 48 is preferably also received on the threaded end of threaded fastener 44 interposed between the nut 46 and the surface of swivel 34.

The detent pin 36 is positioned in an opening 50 which is formed in the swivel 34 at a point spaced from the approximate midpoint of the latter outwardly towards the free end of the swivel 34. The detent pin 36 is received in the opening 50 with a frictional fit and is movable therewithinn between an extended position relative to the swivel 34 as depicted in solid lines in FIG. 4 of the drawings and a retracted position relative thereto as shown in broken lines in the same figure. The manner in which the detent pin 36 is moved between its aforedescribed extended and retracted positions and the purpose for this movement will be described subsequently hereinafter. The detent pin 36 has a circular notch 52 formed thereon at a point closely spaced to but inwardly of the lower end thereof as viewed with reference to FIG. 4 of the drawings. The notch 52 is suitably dimensioned so as to correspond to the width of the slot 54 provided in the right end of the detent arm 38 as viewed with reference to FIG. 3 of the drawings. Accordingly as shown in the later figure, the detent pint 36 and the detent arm 38 are thus capable of being cooperatively associated together through the insertion of the detent pin 36 and more specifically the circular notch 52 thereof into the slot 54 formed in the aforereferenced one end of the detent arm 38.

Figure 2:
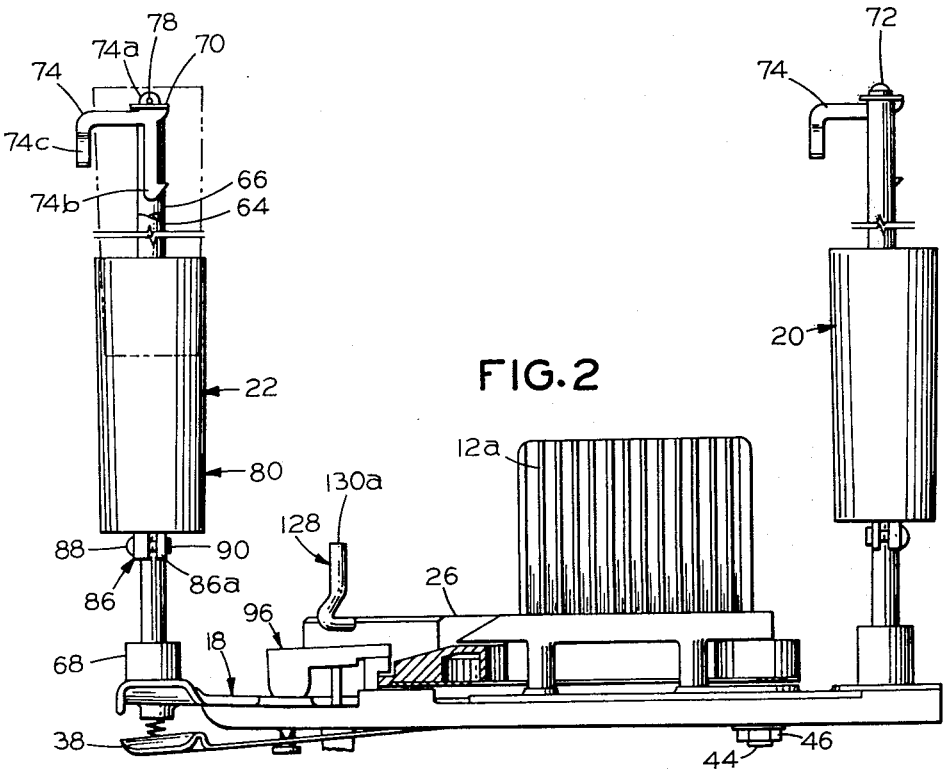
FIG. 2 is a side elevational view of a mitre box constructed in accordance with the present invention with parts omitted for purposes of clarity of illustration.

Approximately at the midpoint of the detent arm 38, there is provided therein another opening (not shown) suitably dimensioned so as to permit the shank **40*a* of the shoulder screw 40 to be passed therethrough. The diameter of the aforereferenced opening (not shown) is selected so as to be less than the diameter of the head 40*b* of the screw 40 thereby preventing the screw 40 from being passed completely therethrough. As best seen in FIGS. 2 and 4 of the drawings, the shoulder screw 40 is received in the swivel 34 and more particularly the under surface of the latter so as to project outwardly therefrom with the head 40*b* of the screw 40 being spaced from the swivel 34. As such, the shoulder screw 40 is capable of functioning as a fulcrum for the detent arm 38 as will be referred to more fully hereinafter. There are in addition two other openings, only one of which, i.e., opening 56 is visible in the drawings, provided intermediate the ends of the detent arm 38. Opening 56 is provided adjacent the free end of the detent arm 38 as can best be seen in FIGS. 3 and 4 of the drawings. The opening 56 provides a means of gaining access to the binding head screw 58 with a screwdriver or other instrument of similar purpose. The other opening (not shown) preferably has an oval-shaped configuration and is suitably dimensioned to permit the protuberance 60 which extends outwardly from the under surface of the swivel 34 to extend therethrough. Further reference will be made to the purpose served by both the binding head screw 58 and the protuberance 60 in the description which follows hereinafter. Completing the description of the detent arm 38, it can be seen with reference to FIG. 3 of the drawings that the free end of the detent arm 38 is provided with a pair of outwardly projecting wings 38*a*. The latter wings 38*a* provide ready access to the detent arm 38 whereby imparting a manual force to either or both of the wings 38*a*, the detent arm 38 can be made to pivot about the shank 40*a* of the shoulder screw 40 and against the bias of spring 42 between a first position depicted in solid lines in FIG. 4 and a second position thereof shown in broken lines in the same figure. The aforedescribed movement of the detent arm 38 is effective in turn to cause the detent pin 36 to move between its extended position and its retracted position relative to the swivel 34. The spring 42 it will be seen with reference to FIG. 4 has one end thereof seated against the portion of the detent arm 38 surrounding the opening 56 formed therein and the other end seated against the under surface of the swivel 34 and more particularly captured within the U-shaped cutout portion 62 formed in the swivel 34** for this purpose.

Referring now to FIG. 2 of the drawings, a description of the pair of upright assemblies 20 and 22 will now be set forth. Inasmuch as the construction of both of the upright assemblies 20 and 22 is substantially the same, for purposes of the description thereof which follows, the structure of only one of the upright assemblies 20, 22 willl be set forth hereinafter with any differences which exist therebetween being suitably noted. Thus, each of the pair of upright assemblies 20, 22 as exemplified with particular reference to the upright assembly 22 includes a pair of posts 64 and 66. The latter posts 64 and 66 have one end thereof supported in a post support 68. The post support 68 functions to support the posts 64 and 66 in an upright position, i.e., substantially perpendicularly to the plane of the swivel 34 and in suitably spaced relation relative to each other. In accord with one embodiment of the invention, the posts 64 and 66 are preferably retained properly positioned in the post support 68 through the use of a pair of socket head cap screws (not shown) which are recieved in suitable openings provided therefor in the post support 68, the latter openings have been omitted from the drawings in the interest of maintaining clarity of illustration. However, it is, of course, to be understood that other equivalent means could be employed to accomplish this function without departing from the essence of the invention. In turn, the post support 68 is fixedly attached to the under surface of the swivel 34 through the use of any conventional securing means (not shown) commonly found employed for purposes of fastening two members together such as by threaded fasteners, etc.

The upper ends of the posts 64 and 66 are interconnected by means of an upright tie 70. The tie 70 attached to the ends of the posts 64 and 66 preferably through the use of threaded fasteners 72 which are passed through openings (not shown) provided for this purpose in the tie 70 and are threadedly received in tapped holes (not shown) formed in the upper ends, as viewed with reference to FIG. 2 of the drawings, of the posts 64 and 66. The upright tie 70 performs another function, i.e., that of mounting means for the latch 74. To this end, the tie 70 is provided with a slot 76 located intermediate the openings (not shown) provided for receiving the aforedescribed fasteners 72. The latch 74 as best understood with reference to FIG. 2 of the drawings includes a semicircular portion 74*a* which is suitably dimensioned so as to be capable of being passed through the aforementioned slot 76. The portion 74*a* has an opening (not shown) formed therethrough which is operable to receive a roll pin 78 which with the portion 74*a* of latch 74 positioned in the slot 76, the main portion of latch 74 extends on one side of the tie 70 and the portion 74*a* extends on the other side of tie 70 so that by inserting the roll pin 78 through the opening (not shown) provided therefor the latch 74 is retained in its assembled condition relative to the tie 70. Moreover, as will be referred to subsequently, the latch 74 in the assembled condition is suitably mounted whereby it can be moved between a latched and an unlatched condition. Referring further to the construction of the latch 74, the latter is provided with a hook-like portion 74*b* by means of which the latching function of latch 74 is accomplished. In addition, latch 74 is provided with a handle-like portion 74*c* which with the latch 74 assembled to the tie 70 is externally accessible so that by applying a force thereto the latch 74 can be made to move between its latched and unlatched condition. In accord with the illustrated form of the invention, the latch 74 is preferably formed as an integral member. Also, the hook-like portion 74*c* of latch 74 is preferably formed by having a portion of the latch 74 bent out of the plane thereof and then the end of this bent portion is turned inwardly so as to lie substantially at right angles to the plane of the major axis of the latch 74.

The upright assemblies 20, 22 are also each provided with saw guide means 80. The saw guide means 80 comprises a pair of semicircular substantially hollow elongated members 82 and 84. Each of the members 82, 84 is provided with an inwardly projecting portion, the latter not being visible in the drawings, which has a through hole (not shown) formed therein. The latter holes are suitably dimensioned so as to be capable of receiving the posts 64 and 66 therein with a sliding fit. Thus, the members 82, 84 of saw guide means 80 are capable of vertical movement as viewed with reference to FIG. 2 of the drawings, along the length of the posts 64, 66, i.e., the members 82 and 84 are capable of being slid up and down on the posts 64 and 66, respectively. The aforereferenced inwardly extending portions (not shown) of the members 82 and 84 are in addition each provided with a slot (not shown) which is formed therein so as to extend substantially at right angles to the plane of the aforereferenced through holes (not shown). The latter slots (not shown) are suitably dimensioned so as to be capable of receiving therein a portion of a latch plate (not shown). The latter latch plate cooperates with the previously described hook-like portion 74*b* of latch 74 to provide a means of latching the saw guide means 80 in a given position along the length of the posts 64 and 66. More specifically, the latch plate (not shown) is provided substantially at its center with a slot through which the hook-like portion 74*b* of latch 74 is capable of passing. The aforesaid latching function is accordingly accomplished through the inner engagement of the hook-like portion 74*b* of latch 74 with the side edges of the slot provided in the latch plate (not shown).

Completing a description of the structural elements embodied in the upright assemblies 20, 22, in accord with the illustrated embodiment of the invention a pair of stops are preferably positioned on the posts 64 and 66 intermediate the post support 68 and the saw guide members 82 and 84. Each of the stops 86 comprises a substantially U-shaped member having a pair of leg portions 86*a* and opening (not shown) formed therein, the latter being suitably dimensioned so as to be capable of accommodating one of the posts 64 or 66 therewithin. The stops 86 are designed so as to be movable relative to the posts 64 and 66. To secure the stops 86 in a given position along the length of the posts 64 and 66, a screw 88 is employed in cooperation with a nut 90. More specifically, the screw 88 is passed through aligned openings (not shown) provided therefor in the legs 86*a* of the stop 86 and is threaded into the nut 90. By tightening the nut 90 on the threaded end of screw 88, the legs 86*a* of stop 86 are drawn closer and closer together until they become effective to clamp the stop 86 on the corresponding post 64 or 66.

Figure 3:
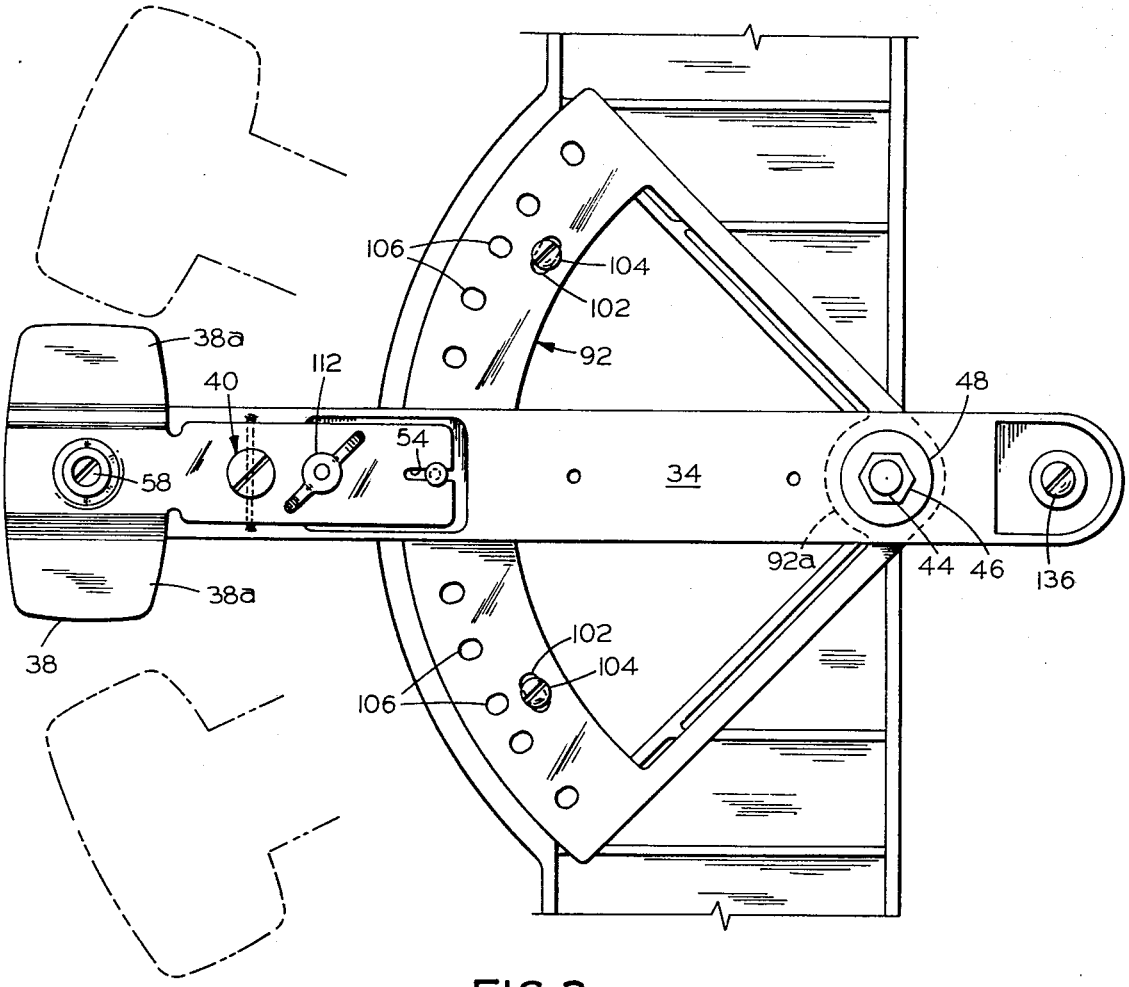
FIG. 3 is a bottom view of a mitre box constructed in accordance with the present invention with parts broken away for purposes of clarity of illustration, and depicting the swivel assembly thereof in solid lines occupying a first position and in broken lines occupying several other positions.
Figure 4:
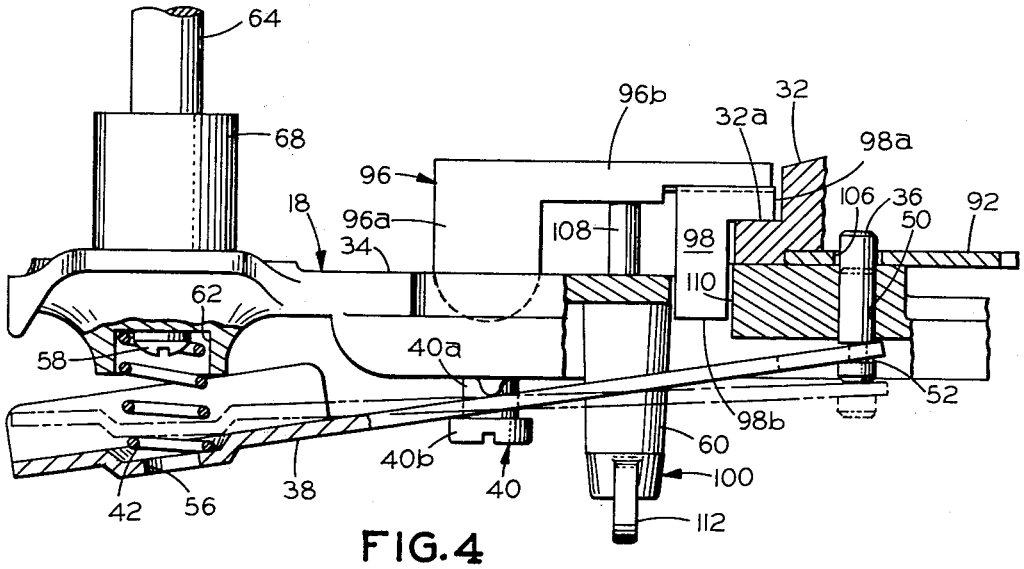
FIG. 4 is a side elevational view partially in section of the swivel assembly of a mitre box constructed in accordance with the present invention.

Referring now to FIGS. 1–4 of the drawings, the mitre box 10 embodies therein indexing means 16, the latter being operable for purposes of establishing in a simple, efficient manner and with a high degree of accuracy the angle of cut, i.e., the angle at which the ends of pieces of materials are to be cut. The indexing means 16 includes an indexing plate 92 of high precision manufacture, and indexing pointer 94, a clamp 96, a lock 98, and tightening means 100. Considering first the indexing plate 92, the latter as best illustrated in FIG. 3 of the drawings, has an outer configuration which is generally pie-shaped in nature and has a substantially hollow interior. The indexing plate 92 is mounted on base 12 of the mitre box 10 by being attached thereto at three points. More specifically, the pointed end of the indexing plate 92 has formed thereat a substantially circular portion 92*a* which has an opening (not shown) formed therein which is suitably dimensioned so as to be capable of enabling the shank of the fastener 44 to be passed therethrough. In adddition, the indexing plate 92 has a pair of elongated holes 102 formed therein at suitably spaced locations. A threaded fastener 104 is passed through each of the elongated holes 102 and is threadedly received in tapped openings (not shown) provided for this purpose in spaced relation in the under surface of the base 12. Thus, as shown in FIG. 3 of the drawings, through the use of the pair of fasteners 104 and the fastener 44, the indexing plate 92 is moutnted to the base 12 so as to be interposed between the upper surface of the swivel 34 and the under surface of the base 12. Note will be also taken at this point in the description of the indexing means 16 that the position of the indexing plate 92 relative to the base 12 may be adjusted to some extent by varying the location of the fasteners 104 in the holes 102. This may be considered in the nature of a fine adjustment of the position of the indexing plate 92. The desirablity of providing this capability of adjustment will be referred to in more detail more subsequently. In addition, as depicted in FIG. 3 of the drawings, the indexing plate 92 is provided with a plurality of suitably spaced holes 106, each of which has a slightly oval configuration. The holes 106 are suitably dimensioned so as to be capable of receiving therewithin a portion of the detent pin 36 in the manner depicted, for example, in FIG. 4 of the drawings. The manner in which the holes 106 are utilized will be set forth hereinafter in connection with the description of the mode of operation of the indexing means 16.

Continuing with the description of the indexing means 16, as best understood with reference to FIGS. 2 and 4 of the drawings, the swivel 34 is adapted to be locked in position relative to the arcuate-shaped member 32 of the base 12. The means by which this locking function is accomplished includes the clamp 96, the lock 98 and the tightening means 100. Referring to FIG. 4 of the drawings, the clamp 96 comprises a member which has a substantially L-shaped configuration, the latter configuration being provided by a short portion 96*a* formed integrally with a long portion 96*b*. Although not visible in the drawings, the short portion 96*a* of the clamp 96 in accord with one embodiment of the invention consists of a pair of depending legs. The long portion 96*b* of clamp 96 has formed therein intermediate the ends thereof a hole (not shown) located approximately centrally between the side edges of portion 96*b*. The purpose of this hole (not shown) is to receive therein the threaded fastener 108 of tightening means 100 to which further reference will be had hereinafter. The length of the short portion 96*a* of clamp 96 is selected so as to be such that when the clamp 96 is positioned on the swivel 34 in the manner such as in FIG. 4 of the drawings, the under surface of portion 96*b* of clamp 96 is capable of being brought into engagement with the lock 98. The latter lock 98 comprises a substantially L-shaped member, the configuration of which is established by a short leg 98*a* which is formed integrally with the long leg 98*b* thereof. The relative dimensions of the legs 98*a* and 98*b* of lock 98 are suitably selected whereby the lock 98 is capable of coacting with the clamp 96 to perform the aforereferenced locking function. To this end, the leg 98*b* of lock 98 is received in a suitably dimensioned opening 110 provided therefor in the swivel 34. When so positioned, the leg 98*a* of lock 98 rests on the shoulder portion 32*a* of the arcuate member 32. In addition, the clamp 96 is suitably located on the upper surface of the swivel 34 so that the fastener 108 extends through the hollow interior of the protuberance 60 with the end thereof being exposed so as to be capable of receiving thereon in threaded engagement therewith the other component of the tightening means 100, i.e., the wing nut 112. When the clamp 96 is so positioned intermediate the ends of the swivel 34, the under surface of the long portion 96*b* thereof is in abutting engagement with the upper surface of leg 98*a* of lock 98. Moreover, it should be readily apparent that as the wing nut 112 is tightened on threaded fastener 108, the portion 96*b* of clamp 96 will impart a downward force as viewed with reference to FIG. 4 of the drawings. The result is that the lock 98 and more particularly the leg 98*a* thereof is caused to bear tightly against the shoulder portion 32*a* of arcuate member 32. The effect of this action is to lock the swivel 34 in position relative to the arcuate member 32 and thereby prevent the swivel 34 from moving relative to the base 12, thereby defining the angle of cut, i.e., the angle at which the ends of pieces of materials will be cut. This angle can be readily varied merely by loosening the wing nut 112 thereby permitting the swivel 34 to be moved relative to the surface of the arcuate member 32 until the swivel 34 is located at the desired position. Thereafter, the wing nut 112 is again tightened locking the swivel 34 in the new position.

The last component of the indexing means 16 yet to be described comprises the indexing pointer 94 which is best seen in FIG. 1 of the drawings. The indexing pointer 94 comprises an elongated member having a pointed tip 94*a*. The pointer 94 is fixedly mounted on the swivel 34 for movement therewith. Although any suitable conventional fastening means may be employed for purposes of mounting the indexing pointer 94 on the swivel 34, in accord with the illustrated embodiment of the invention a pair of threaded fasteners 114 are utilized for this purpose. The fasteners 114 are passed through a pair of suitably dimensioned openings (not shown) formed in spaced relation in the pointer 94 and are threadedly received in a pair of suitably located tapped openings (not shown) which are provided for this purpose in the swivel 34. The indexing pointer 94 as best understood with reference to FIG. 1 of the drawings is mounted on the swivel 34 with tip 94*a* of the former being located adjacent suitable indicia 116 which is provided on the surface of the arcuate-shaped member 32 of the base 12. The latter indicia 116 is in the form of a plurality of angular values. Accordingly, by reading the value indicated by the indicia 116 opposite the tip 94*a* of the pointer 94, it is possible to determine the angle of cut. The latter angle, as best understood with refernce to FIG. 1 of the drawings, comprises the angle of the arc defined by the upstanding rear wall portion 12*a* or 12*b* of the base 12 and the longitudinal axis of the swivel 34. In accord with the illustrated embodiment of the invention, the indicia 116 denotes angles of 45° to 90°.

Figure 6:
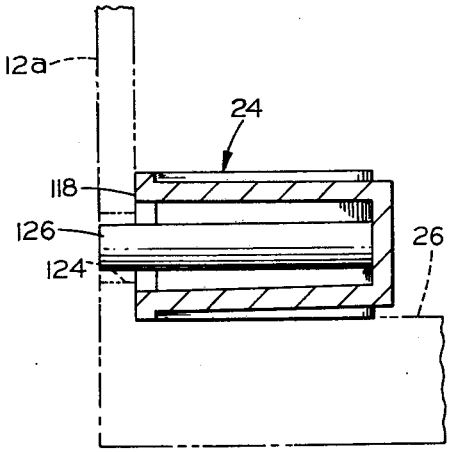
FIG. 6 is a cross-sectional view of the wedge which is adapted to be employed with a mitre box constructed in accordance with the present invention, for use in providing a 30° angle.

The mitre box 10 constructed in accord with the present invention possesses the additional capability of being adapted to be employed with means operable for providing a 30° angle. The latter referenced means comprises the wedge 24, which has been previously referred to hereinbefore and which is found illustrated in FIGS. 5 and 6 of the drawings. Referring to the latter two figures, it will be readily seen therefrom that the wedge 24 comprises a triangular-shaped member. More specifically, the wedge 24 is in the shape of a right angle triangle having a pair of sides 118 and 120 which meet to form a right angle with the third side 122 of the wedge 24 comprising the diagonal which connects the ends of the other two sides 118, 120 of the wedge 24. When it is desired to employ the wedge 24, the latter is mounted on either the portion 26 or the portion 28 of the base 12 depending on the nature of the cut which is to be made utilizing the mitre box 10. To accomplish this mounting of the wedge 24 on the base 12, openings 124 are suitably located in the surface of both the portions 12*a* and 12*b* of the base 12. One of the latter openings 124 has been illustrated in broken lines in FIG. 6 of the drawings. It is to be understood that these openings 124 are suitably located so that when the wedge 24 is mounted on either portion 26 or the portion 28 one side of the wedge 24 is in substantially abutting engagement along the entire length thereof with the inner surface of one of the upstanding rear wall portions of the base 12. This is best exemplified by reference to FIG. 5 of the drawings wherein the side 118 of the wedge 24 is depicted as being in engagement with the inner surface of the rear wall portion 12*a* of the base 12. For purposes of maintaining the wedge 24 properly mounted on the base 12, the former as shown in FIG. 6 of the drawings is provided with a depending stud portion 126. The latter stud portion 126 is suitably dimensioned so as to be receivable within either the opening 124 which is provided in the surface of the portion 26 or that provided in the surface of the portion 28, in the manner exemplified in the illustration of FIG. 6. With the wedge 24 mounted on the base 12 as shown, for example, in FIG.

5 of the drawings, the angle of the arc defined by the diagonal side 122 of the wedge 24 and the 45° angle indicia depicted most closely thereto on the arcuate member 32 of the base 12 comprises 30°.

Completing the description of the structural elements embodied in the mitre box 10, as shown in FIG. 1 of the drawings the mitre box 10 is preferably provided with a plurality of retaining means 128 operable for purposes of securing the pieces of materials to be cut in position on the base 12. To this end, each of the retaining means 128 includes a rod-like member 130, which is received in a suitable cutout portion (not shown) formed in the surface of the base 12 and more particularly the portions 26 and 28 thereof, and a wing nut 132 which is suitably received in the projection 134 located at the rear of the base 12 through which the rod-like member 130 extends whereby by tightening the wing nut 132 the rod-like member 130 can be fixed against movement in a given position, i.e., with the upstanding portion 130*a* of the rod-like member 130 located at a given point.

Reference will now be had to the manner in which the mitre box 10 functions in connection with the cutting of the ends of pieces of material at equal angles. To establish the desired angle of cut, i.e., the angle at which it is desired to cut the end of a piece of material, it is necessary to position the swivel 34 so that the tip 94*a* of the pointer 94 points to the angular value denoted by the indicia 116 which corresponds to the desired angle of cut. Unless the swivel 34 just happens to be located in the proper position, it will be necessary to move the swivel 34 relative to the arcuate member 32. As noted previously hereinabove, in order to enable the swivel 34 to be pivoted about the fastener 44, it is necessary for the wing nut 112 to be in a loosened condition and the detent pin 36 to be in its retracted position, i.e., be withdrawn from any of the holes 106. Moreover, as set forth previously, in order to cause the detent pin 36 to move to its retracted position, an upward force must be applied to one or more of the wings 38*a* of the detent arm 38 to cause the latter to pivot against the bias of spring 42 and apply a downward force on the detent pin 36 withdrawing the latter from any one of the holes 106 in which it may have been positioned. With both of the aforementioned conditions existing, the swivel 34 may be moved until it is aligned in a position wherein the desired angle of cut may be obtained. By once again tightening the wing nut 112, the swivel 34 will be secured against movement in the desired position. Employing the retaining means 128 the piece of material to be cut is secured on the surface of the base 12. Thereafter the stops 86 are adjusted to the proper position on the posts 64 and 66. The saw guide means 80 is released from its latched condition through operation of the portion 74*c* of the latch 74. By employing the cutting instrument (not shown) positioned in the saw guide means 80, the end of the piece of material supported on the base 12 is cut to the desired angle. After the desired cut has been accomplished, the above described procedure is reversed for purposes of removing from the base 12 the piece of material which has now been cut. The above described procedure may then be repeated for purposes of cutting the end of the other piece of material which it is desired to join to form a joint with the first piece that was cut. In the event that it is determined during the course of employing the mitre box 10 that the indexing plate 92 should be adjusted, this latter adjustment is capable of being accomplished simply by loosening the pair of screws 104 and moving the indexing plate 92 relative to the under surface of the base 12 about the fastener 44. Moreover, in the event that it is desired to make a cut of 30°, the wedge 24 may be mounted on the base 12 and utilized in the manner which has been described in detail previously hereinabove.

Although only one embodiment of a mitre box constructed in accordance with the present invention has been shown in the drawings and described hereinabove, it is to be understood that modifications in the construction thereof may be made thereto by those skilled in the art without departing from the essence of the invention. In this connection, some of the modifications which can be made in the mitre box 10 have been alluded to hereinabove while others will become readily apparent to those skilled in the art when exposed to the present description and illustration of the construction of the mitre box 10. For example, in accord with the preferred embodiment of the invention, a number of structural elements of the mitre box 10 including the base 12, the swivel 34 and the saw guide means 80 are formed from a suitable non-ferrous material possessing the desired structural strength while yet being characterized by its relative inexpensiveness. Moreover, the indexing plate 92 is preferably made with a high degree of precision from metal by the process known to those skilled in the art of metalworking as the "fine blanking" process. The very desirable result of this mode of construction is that accurate indexing may be acheived by virtue of the high precision by which the indexing plate 92 is made, yet because a number of the structural elements of the mitre box 10 are made from relatively inexpensive materials and through relatively inexpensive manufacturing processes, the total cost of manufacture of the mitre box 10 is maintained at a very attractive level vis-a-vis the cost of those prior art forms of mitre box which possess the capability of providing the degree of indexing accuracy capable of being achieved with the mitre box 10 constructed in accordance with the present invention. Accordingly, although it would be possible to employ structural elements in the mitre box 10 which are made from materials other than those noted above, to do so would generally result in providing a mitre box which when compared to the mitre box 10 of the present invention is disadvantageously characterized insofar as concerns accuracy of indexing, facility with which adjustments of the indexing plate and/or the swivel assembly may be accomplished, and the cost of manufacture thereof. Also, as seen in FIG. 3 of the drawings, the post supports 68 are shown as being secured to the swivel 34 by means of fasteners 58 and 136, it is to be understood that some other equivalent form of fastening means could be employed for this purpose without departing from the essence of the invention. Moreover, it is obvious in addition that some form of means other than the retaining means 128 could be employed for purposes of securing the piece of material to be cut on the surface of the base 12 without departing from the essence of the invention.

Thus, it can be seen that the present invention provides a novel and improved mitre box operable for use in cutting the ends of pieces of materials at equal angles. The mitre box in accord with the present invention embodies improved indexing means. Moreover, in accord with the present invention a mitre box is provided embodying improved indexing means capable of providing accurate indexing with a high degree of precision. In addition, a mitre box is provided in accord with the present invention embodying improved indexing means whereby the latter means is readily adjustable in a simple and efficient manner. Also, the mitre box with improved indexing means of the present invention has a relatively simple structure and is relative inexpensive to manufacture. Finally, in accord with the present invention, a mitre box with improved indexing means has been provided which is adapted to be employed with a wedge which is operable to provide a 30° angle.

Having thus described the invention, we claim:

1. A mitre box particularly adapted for use in cutting the ends of pieces of material at predetermined angles comprising:

a. a base formed of non-ferrous metal operable for supporting thereon the piece of material to be cut, said base including an arcuate-shaped section consisting of a raised portion having indicia provided thereon denoting a multiplicity of different values of angular measurement and a flange portion extending outwardly of said raised portion providing a shoulder;

b. swivel assembly means supported on said base for movement relative thereto, said swivel assembly means including a swivel having one end thereof pivotably mounted on said base and having first and second openings formed therein in spaced relation relative to each other adjacent to the free end of said swivel, a detent pin supported on said swivel for movement between an extended position and a retracted position relative thereto, a detent arm supported on said swivel for pivotal movement relative thereto having one end thereof cooperatively associated with said detent pin and operable for moving said detent pin from said extended position to said retracted position thereof, and a spring having one end thereof seated against said swivel and the other end thereof seated against said detent arm operable for imparting a biasing force to said detent arm to move said detent pin to said extended position thereof;

c. locking means operable for detachably locking said swivel assembly means in aligned relation relative to any given one of said multiplicity of different values of angular measurement, said locking means including a locking member, a clamping member and tightening means, said locking member including a first leg portion and a second leg portion extending outwardly therefrom so as to provide substantially a right angle therebetween, said first leg portion of said locking member being positioned in said first opening in said swivel so as to be movable therewithin between a first position wherein said second leg portion of said locking member is in locking engagement with said flange portion of said arcuate member of said base and a second position wherein said second leg portion of said locking member is spaced from said flange portion of said arcuate section of said base, said clamping member including a first leg portion and a second leg portion extending outwardly therefrom so as to provide substantially a right angle therebetween, said clamping member being mounted on said swivel so as to be movable relative thereto with said first leg portion of said clamping member in engagement with said swivel at a point adjacent to said first and second openings in said swivel and with said second leg portion of said clamping member in engagement with said second leg portion of said locking member so as to be operable to selectively apply a bearing force thereto causing said second leg portion of said locking member when said bearing force is applied thereto by said second leg portion of said clamping member to be positioned in locking engagement with said flange portion of said arcuate section of said base and said first leg portion of said locking member to move between said second position and said first position thereof, said tightening means including a fastener supported in said second opening in said swivel so as to extend therethrough and having one end thereof affixed to said second leg portion of said clamping member, said tightening means further including means threadedly engaged on said fastener at the other end thereof operable through the tightening and loosening thereof to cause said second leg portion of said clamping member to selectively apply said bearing force to said second leg portion of said locking member;

d. upright assembly means supported on said swivel assembly means for movement therewith, said upright assemlby means including a pair of upright assemblies with one of said pair of upright assemblies being supported at one end of said swivel and the other of said pair of upright assemblies supported at the other end of said swivel, said upright assembly means further including guide means supported on said pair of upright assemblies operable for guiding a cutting instrument during a cutting operation; and e. indexing means including an indexing plate made to precise dimensions supported on said base between said base and swivel and having means formed thereon cooperating with said swivel assembly means for establishing a very accurate angle of cut, said means of said indexing plate cooperating with said swivel asembly means comprising a plurality of spaced openings formed therethrough cooperating with said detent pin of said swivel assembly means when said detent pin is in said extended position thereof to cause said swivel to be locked to said indexing plate, said indexing means further including adjustment means formed on said indexing plate operable for adjusting the position of said indexing plate relative to said base and pointer means mounted on said swivel assembly means for movement therewith to identify the given one of said multiplicity of different values of angular measurement with which said swivel assembly means is aligned, said pointer means comprising an indexing pointer fixedly mounted on said swivel with the major axis of said indexing pointer coinciding with the major axis of said swivel.

2. The mitre box as set forth in claim 1 wherein said base further includes a pair of polygonal-shaped portions interconnected at one end by said arcuate-shaped member and at the other end by a circular-shaped member.

3. The mitre box as set forth in claim 2 further including retaining means supported on each of said polygonal-shaped portions of said base operable for securing thereto pieces of material to be cut on said base.

4. The mitre box as set forth in claim 2 further including a wedge selectively supportable on either of said pair of polygonal-shaped portions so as to cooperate with the end of said arcuate-shaped member closest thereto to define therebetween a 30° angle, and means provided on said base for detachably mounting said wedge on either of said pair of polygonal-shaped portions thereof.

5. A mitre box particularly adapted for use in cutting the ends of pieces of material at predetermined angles comprising:

a. a base formed of non-ferrous metal operable for supporting thereon the piece of material to be cut, said base including an arcuate-shaped section consisting of a raised portion having indicia provided thereon denoting a multiplicity of different values of angular measurement and a flange portion radially outwardly of said raised portion providing a generally radially extending shoulder spaced from the plane of said raised portion;

b. swivel assembly means supported on said base for movement relative thereto, said swivel assembly means including a swivel having one end thereof pivotably mounted on said base;

c. locking means oprable for detachably locking said swivel assembly means in aligned relation relative to any given one of said multiplicity of different values of angular measurement, said locking means including a locking member, a clamping member and tightening meeans, said locking member including a first leg portion and a second leg portion extending outwardly therefrom so as to provide substantially a right angle therebetween, said first leg portion of said locking member being positioned in an opening in said swivel so as to be movable therewithin between a first position wherein said second leg portion of said locking member is in locking engagement with said shoulder of said flange portion of said arcuate section of said base and a second position wherein said second leg portion of said locking member is spaced from said should of said flange portion of said arcuate section of said base, said clamping member including a first leg portion and a second leg portion extending outwardly therefrom so as to provide substantially a right angle therebetween, said clamping member being mounted on said swivel so as to be movable relative thereto with said first leg portion of said clamping member in engagement with said swivel at a point adjacent to said opening in said swivel and with said second leg portion of said clamping member in engagement with said second leg portion of said locking member so as to be operable to selectively apply a bearing force thereto causing said second leg portion of said locking member when said bearing force is applied thereto by said second leg portion of said clamping member to be positioned in locking engagement with said shoulder of said flange portion of said arcuate member of said base and said first leg portion of said locking member to move between said second position and said first position thereof, said tightening means including a member seated in said swivel so as to extend therethrough and engaged with said second leg portion of said clamping member to move said second leg portion of said clamping member against and away from said second leg portion of said locking member;

d. upright assembly means supported on said swivel assembly means for movement therewith, said upright assembly means including a pair of upright assemblies with one of said pair of upright assemblies being supported at one end of said swivel and the other of said pair of upright assemblies supported at the other end of said swivel; and e. indexing means including an indexing plate made to precise dimensons adjustably supported on said base between said base and swivel and having means formed thereon cooperating with said swivel assembly means for establishing a very accurate angle of cut, said means of said indexing plate cooperating with said swivel assembly means to releasably lock said swivel to said indexing plate, said indexing means further including adjustment means formed on said indexing plate operable for adjusting the position of said indexing plate relative to said base and pointer means mounted on said swivel assembly means for movement therewith to identify the given one of said multiplicity of different values of angular measurement with which said swivel assembly means is aligned.

6. The mitre box as set forth in claim 5 wherein said base is formed as an integral member and includes a pair of polygonal-shaped portions interconnected at one end by a circular-shaped section and at the other end by said arcuate-shaped section.

7. The mitre box as set forth in claim 6 further comprising retaining means supported on each of said polygonal-shaped portions of said base operable for securing pieces of material to be cut on said base.

8. The mitre box as set forth in claim 5 wherein said swivel assembly means includes a detent pin supported on said swivel for movement between an extended position and a retracted position relative thereto, a detent arm supported on said swivel for pivotal movement relative thereto having one end thereof cooperatively associated wiith said detent pin and operable for moving said detent pin from said extended position to said retracted position thereof, and a spring having one end thereof seated against said swivel and the other end thereof seated against said detent arm operable for imparting a biasing force to said detent arm to move said detent pin to said extended position thereof.

9. The mitre box as set forth in claim 8 wherein said indexing plate means cooperating with said swivel assembly means comprises a plurality of spaced openings formed through said indexing plate cooperating with said detent pin of said swivel assembly means when said detent pin is in said extended position thereof to cause said swivel to be locked to said indexing plate, and wherein said pointer means comprises an indexing pointer fixedly mounted on said swivel with the major axis of said indexing pointer coinciding with the major axis of said swivel.

10. The mitre box as set forth in claim 5 further comprising a wedge supported on said base operable for defining a 30° angle, and means provided on said base for detachably mounting said wedge thereon.

* * * * *